US007431246B1

(12) United States Patent
Habib

(10) Patent No.: US 7,431,246 B1
(45) Date of Patent: Oct. 7, 2008

(54) REFUSE CONTAINER HOLDER SYSTEM

(76) Inventor: Joseph M. Habib, 10 Brigham Rd., Paxton, MA (US) 01612

( * ) Notice: Subject to any disclaimer, the term of this patent is extended or adjusted under 35 U.S.C. 154(b) by 0 days.

(21) Appl. No.: 11/503,657

(22) Filed: Aug. 14, 2006

Related U.S. Application Data

(60) Provisional application No. 60/707,644, filed on Aug. 12, 2005.

(51) Int. Cl.
*A47G 23/02* (2006.01)

(52) U.S. Cl. ..... 248/146; 211/85.19; 248/907

(58) Field of Classification Search ..... 248/146, 248/907; 211/178, 85.19; 220/908, 608
See application file for complete search history.

(56) References Cited

U.S. PATENT DOCUMENTS

| | | | | | |
|---|---|---|---|---|---|
| 2,448,456 | A | * | 6/1948 | Niskanen et al. | 211/85.19 |
| 2,471,257 | A | * | 5/1949 | Blank | 248/146 |
| 2,701,700 | A | | 2/1955 | Williamson | |
| 2,929,512 | A | | 3/1960 | McDougle | |
| 3,091,342 | A | * | 5/1963 | Crump | 211/85.19 |
| 3,128,981 | A | * | 4/1964 | Fuestsch et al. | 248/146 |
| 3,240,459 | A | * | 3/1966 | Spohn, Jr. | 248/146 |
| 3,268,086 | A | * | 8/1966 | Hendrickson | 211/85.19 |
| 3,279,619 | A | * | 10/1966 | Alissandratos | 211/85.19 |
| 3,288,305 | A | * | 11/1966 | Bryant et al. | 211/85.19 |
| 3,313,423 | A | | 4/1967 | Anders | |
| 3,666,223 | A | | 5/1972 | Moore | |
| 3,675,783 | A | | 7/1972 | Reese | |
| 3,788,583 | A | * | 1/1974 | Byrd | 248/146 |
| 3,892,315 | A | * | 7/1975 | Johnson | 211/85.19 |
| 4,184,659 | A | | 1/1980 | Abrahamson | |
| 4,191,297 | A | * | 3/1980 | Hardman | 211/83 |
| 4,527,695 | A | * | 7/1985 | Arms | 211/85.19 |
| 4,860,909 | A | * | 8/1989 | Leumi | 220/475 |
| 5,213,294 | A | * | 5/1993 | DeBord | 248/147 |
| 5,887,834 | A | | 3/1999 | Gellos et al. | |

* cited by examiner

*Primary Examiner*—Ramon O Ramirez
(74) *Attorney, Agent, or Firm*—Blodgett & Blodgett, P.C.

(57) ABSTRACT

A refuse container holder for holding and physically stabilizing refuse containers, especially when those refuse containers are positioned at the curbside in front of the residence. A device includes a vertical element, that includes an upwardly directed hook that are capable of engaging a handle on a refuse container so that the refuse container cannot be overturned or moved by the wind but can easily be lifted off the hook by a refuse collector and may include a plastic casing. The device also includes a horizontal element. Each refuse container has a groove in its bottom surface adapted to engage the horizontal element and thereby enhance the stability of the refuse container on the horizontal element.

11 Claims, 13 Drawing Sheets

REFUSE CONTAINER HOLDER SYSTEM

CROSS-REFERENCE TO RELATED APPLICATIONS

This application claims the benefit under 35 U.S.C. section 119(e) of U.S. Provisional Application No. 60/707,644 filed Aug. 12, 2005, which is hereby incorporated by reference.

STATEMENT REGARDING FEDERALLY SPONSORED RESEARCH OR DEVELOPMENT

This invention has been created without the sponsorship or funding of any federally sponsored research or development program.

REFERENCE TO SEQUENCE LISTING, A TABLE, OR A COMPUTER PROGRAM LISTING COMPACT DISK APPENDIX

Not applicable

BACKGROUND OF THE INVENTION

It has become very common for residential refuse to be placed in containers in front of the residence so that the refuse can be collected at the curbside by refuse collection organizations. Because refuse containers tend to be relatively large volume, so that they can hold significant refuse, but relatively light in weight, so that they are relatively easy to move from the residence to the curbside and relatively easy to empty into the refuse collection vehicle, the containers are inherently physically unstable. When the refuse containers are standing by the curbside filled with refuse, they are often disturbed by the wind or roaming animals and are knocked over, spilling the refuse in allowing it to be scattered around the ground. Furthermore, after the refuse has been removed from the containers, the wind frequently most the containers down the sidewalks, and out into to the streets with the containers are sometimes crushed by vehicles and otherwise create dangerous obstacles to traffic. Furthermore, the containers themselves are often lost as a travel around the neighborhood with the wind.

These and other difficulties experienced with the prior art devices have been obviated in a novel manner by the present invention.

It is, therefore, an outstanding object of the present invention to provide a refuse container holder that is capable of stabilizing the position of the refuse container with or without refuse.

Another object of this invention is to provide a refuse container holder from which the refuse container can be easily removed for emptying of the refuse or for transport back to the residence.

A further object of the present invention is to provide a refuse container holder which can be designed in an aesthetically pleasing manner so as not to detract from the appearance of the residence.

It is a further object of the invention to provide a refuse container holder which is capable of being manufactured of high quality and at a low cost, which is capable of being easily installed, and which is capable of providing a long and useful life with a minimum of maintenance.

With these and other objects in view, as will be apparent to those skilled in the art, the invention resides in the combination of parts set forth in the specification and covered by the claims appended hereto, it being understood that changes in the precise embodiment of the invention herein disclosed may be made within the scope of what is claimed without departing from the spirit of the invention.

BRIEF SUMMARY OF THE INVENTION

This invention is a device for holding and physically stabilizing refuse containers, especially when those refuse containers are positioned at the curbside in front of the residence. A device includes a vertical element, and especially a vertical element rendered stationary by being buried in the ground. It could also be stabilized by being mounted on a stable base that could be movable with effort but not by the normal wind. The vertical element includes one or more upwardly directed hooks that are capable of engaging a handle on a refuse container so that the refuse container cannot be overturned or moved by the wind but can easily be lifted off the hook by a refuse collector. Each hook is capable of engaging a separate refuse container or several hooks could be arranged in a linear manner to more stably engage an elongated handle on the refuse container. The device might also include a horizontal element parallel to and adjacent the ground upon which the refuse containers can sit.

This invention may include a plastic casing to provide structure, improve appearance, and ease maintenance. This invention may also include a cooperation between the horizontal element and grooves in the bottom of the containers. The grooves engage the upper surface of the horizontal elements to stabilize the container on the holder.

BRIEF DESCRIPTION OF THE SEVERAL VIEWS OF THE DRAWING

The character of the invention, however, may best be understood by reference to one of its structural forms, as illustrated by the accompanying drawings, in which.

DETAILED DESCRIPTION OF THE INVENTION

First Embodiment

Figure 1:
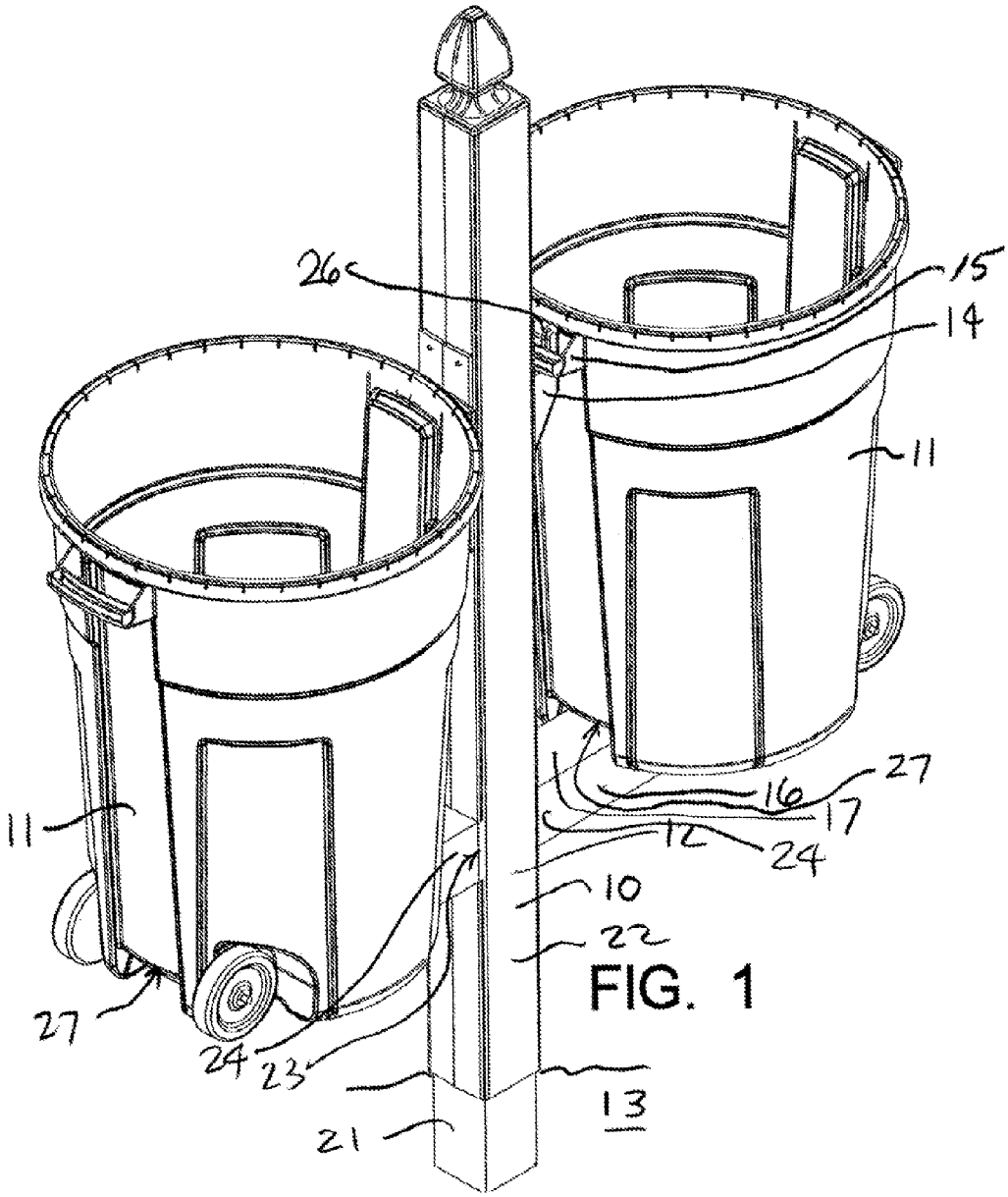
FIG. 1 is a perspective view of a first embodiment of a refuse container holder for holding two refuse containers, the lower portion of the holder being adapted to be buried in the ground, and the holder including a vertical element, two hook elements, and a horizontal element, and embodying the principles of the present invention.

Referring first to FIG. 1, in which are shown the general features of the present invention, and more specifically the first embodiment, this invention is shown as a holding device 10 for holding and physically stabilizing refuse containers 11, especially when those refuse containers 11 are positioned at the curbside in front of the residence. The device 10 includes a vertical element 12, and especially a vertical element 12 rendered stationary by being buried in the ground 13. It could also be stabilized by being mounted on a stable base that could be movable with effort but not by the normal wind. The vertical element 12 includes one or more upwardly directed hooks 14 that include upwardly directed pins 26 that are capable of engaging a handle 15 on a refuse container 11 so that the refuse container 11 cannot be overturned or moved by the wind, but can easily be lifted off the hook 14 by a refuse collector. Each hook 14 is capable of engaging a separate refuse container 11 or several hooks 14 could be arranged in a linear manner to more stably engage an elongated handle 15 on the refuse container 11. The holding device 10 might also include a horizontal element 16, parallel to and adjacent the ground 13. The horizontal element 16 is provided with one or more upper edges 17 upon which the refuse containers 11 can sit.

In one preferred embodiment of this invention, the vertical element 12 would consist of a base element 21 and a vertical element casing 22. The base element 21 would typically be formed of a four inch by four inch piece of pressure treated lumber and a portion of the base element 21 would be permanently buried in the ground. The vertical element casing 22 would be typically formed of a plastic and would be designed to slide over and completely encase the free end and all exposed surfaces of the base element 21 when the bottom of the base element is buried in the ground. This vertical element casing 22 would provide a durable protective and decorative surface over the base element 21. Typically, the vertical element casing 22 would be sold as a very light and easy-to-ship element of a product kit and would allow a highly stylized attractive product to be produced. On the other hand, the base element 21, which would be heavy, and difficult and expensive to ship, would typically be generic and could be purchased from a local lumber store.

Typically, the vertical element casing and other plastic parts would be thermoformed from ¼ inch thick white Poly (Acrylonitrile, Butadiene, Styrene) (ABS) polymer sheet. The vertical element casing would typically be formed using twin sheet thermoforming to form a box, closed at the top and open at the bottom, with a square cross-section sized to snugly fit over a four inch by four inch pressure treated lumber post, which is actually 3½ inch by 3½ inch cross-section.

In another preferred embodiment of this invention, each of the containers 11 used with this system would be provided with a groove 27 in the bottom of the container 11, passing entirely from one side of the container to the other. The groove 27 would typically be of rectangular cross-section. As discussed above, the horizontal element 16 would be provided with one or more upper edges 17 upon which the refuse containers 11 could sit. The groove in the bottom of the container 11 conforms in shape to the upper edges 17 of the horizontal elements 16, so that the groove 27 in the bottom of the container 11 encircles and physically engages the upper edge 17. This provides a very stable connection, when combined with the engagement of the upwardly directed hooks 14 and the handles 15 of the container, with the holder 10, against unintentional removal of the container from the holder 10.

In this embodiment of this invention, the horizontal element 16 is connected to the vertical element 12 by passing the horizontal element 16 through openings 23 in the vertical element casing 22 so that the horizontal element 16 extends from diametrically opposed sides of the vertical element casing 22 to form the arms 24. The horizontal element 16 would rest on the top surface of the base element 21. The horizontal element 16 could be formed of structural plastic and could be hollow. It could also be a piece of pressure treated lumber purchased from a local lumber yard.

Figure 2:
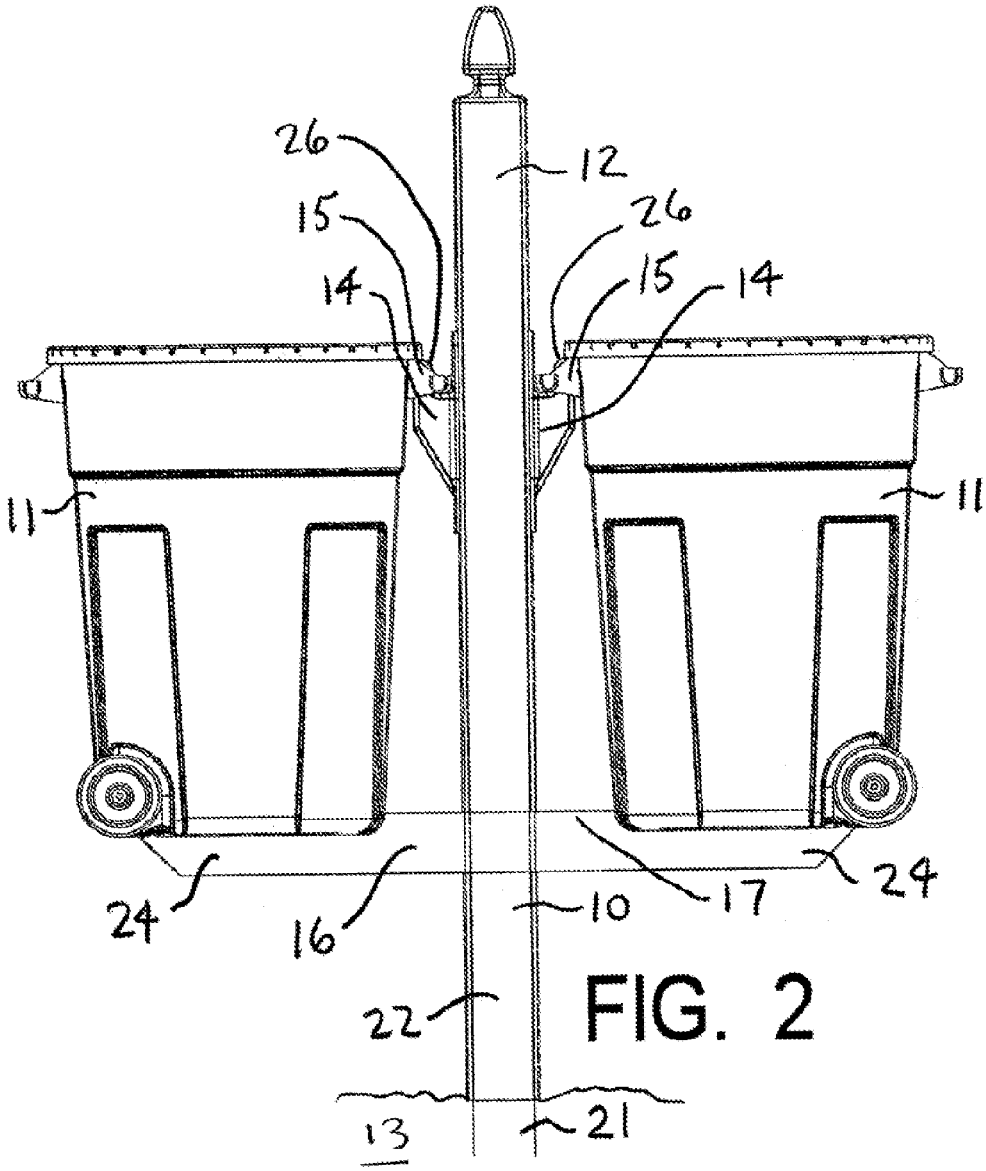
FIG. 2 is a front elevation view of the first embodiment shown in FIG. 1. It is the same as the rear elevation view.

FIG. 2 is a front elevation view of the first embodiment shown in FIG. 1. It is the same as the rear elevation view.

Figure 3:
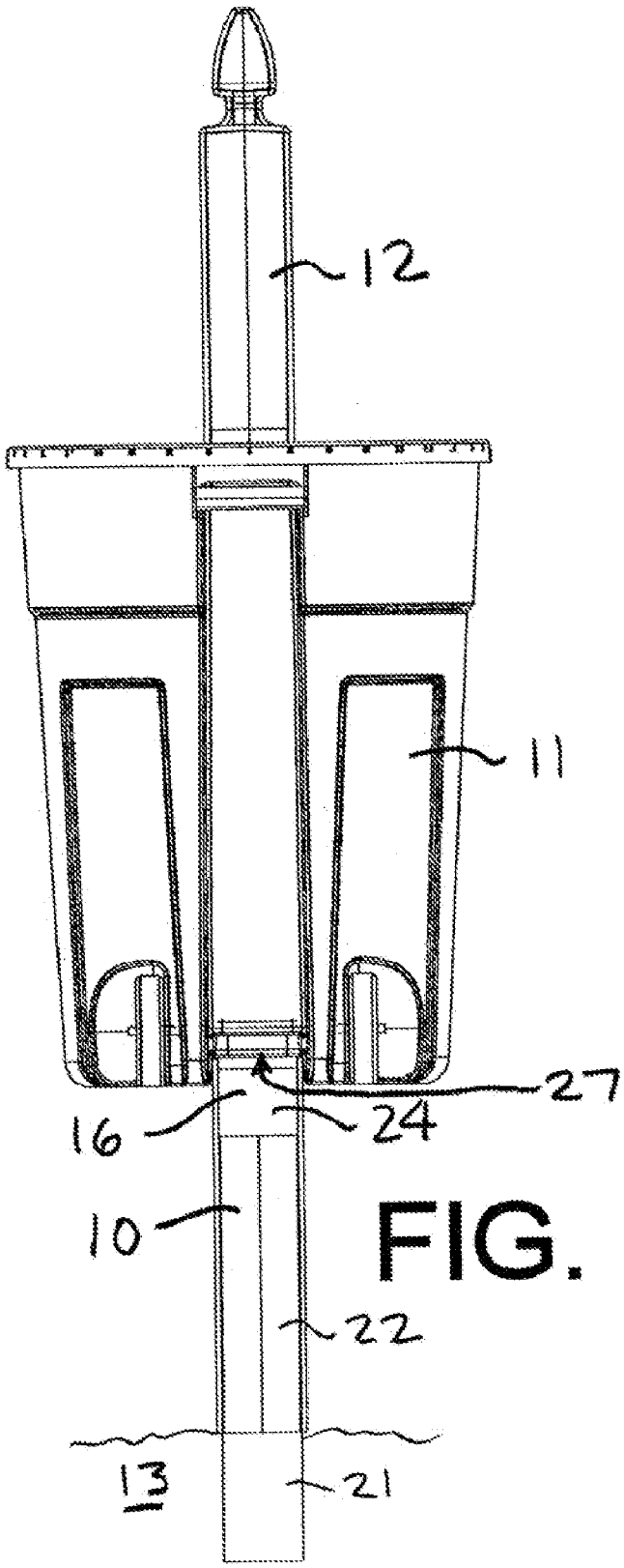
FIG. 3 is a left side elevation view of the first embodiment shown in FIG. 1. It is the same as the right side elevation view.

FIG. 3 is a left side elevation view of the first embodiment shown in FIG. 1. It is the same as the right side elevation view.

Figure 4:
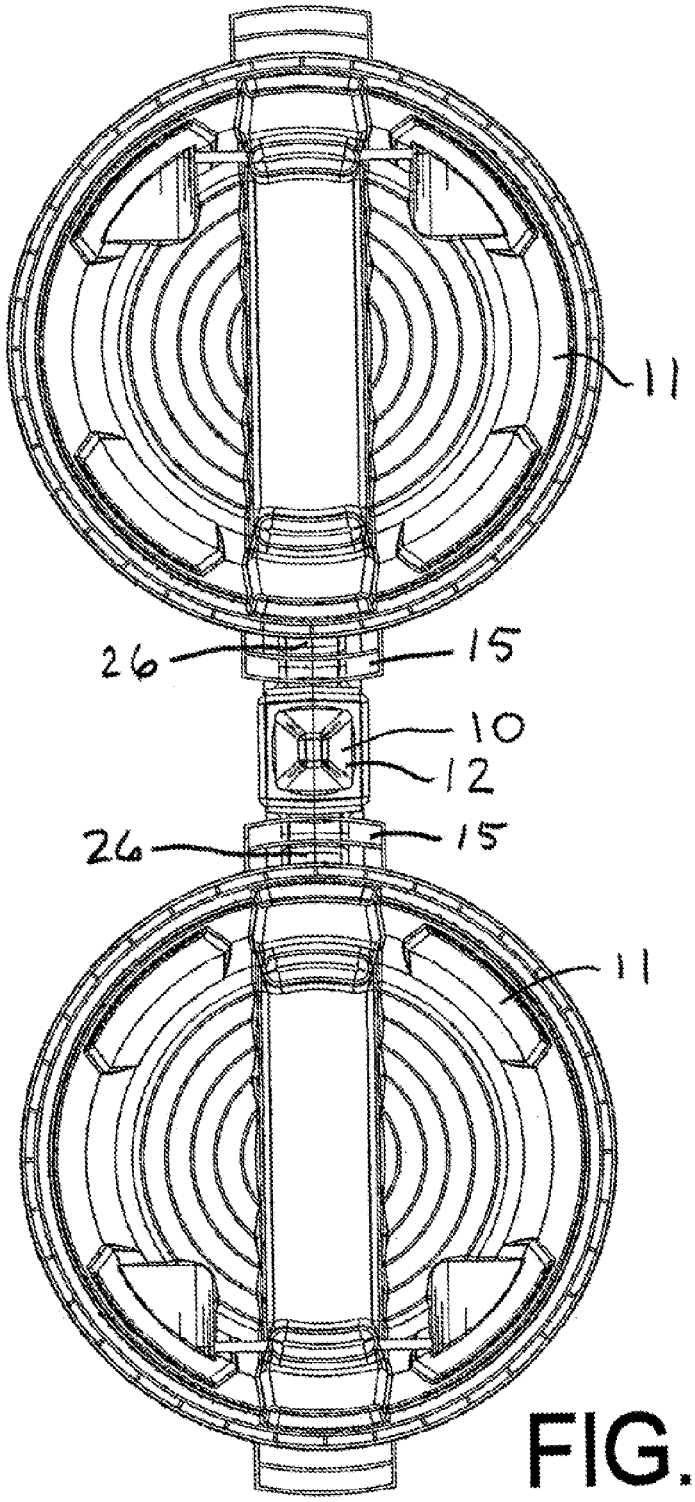
FIG. 4 is a top view of the first embodiment shown in FIG. 1.

FIG. 4 is a top view of the first embodiment shown in FIG. 1.

Figure 5:
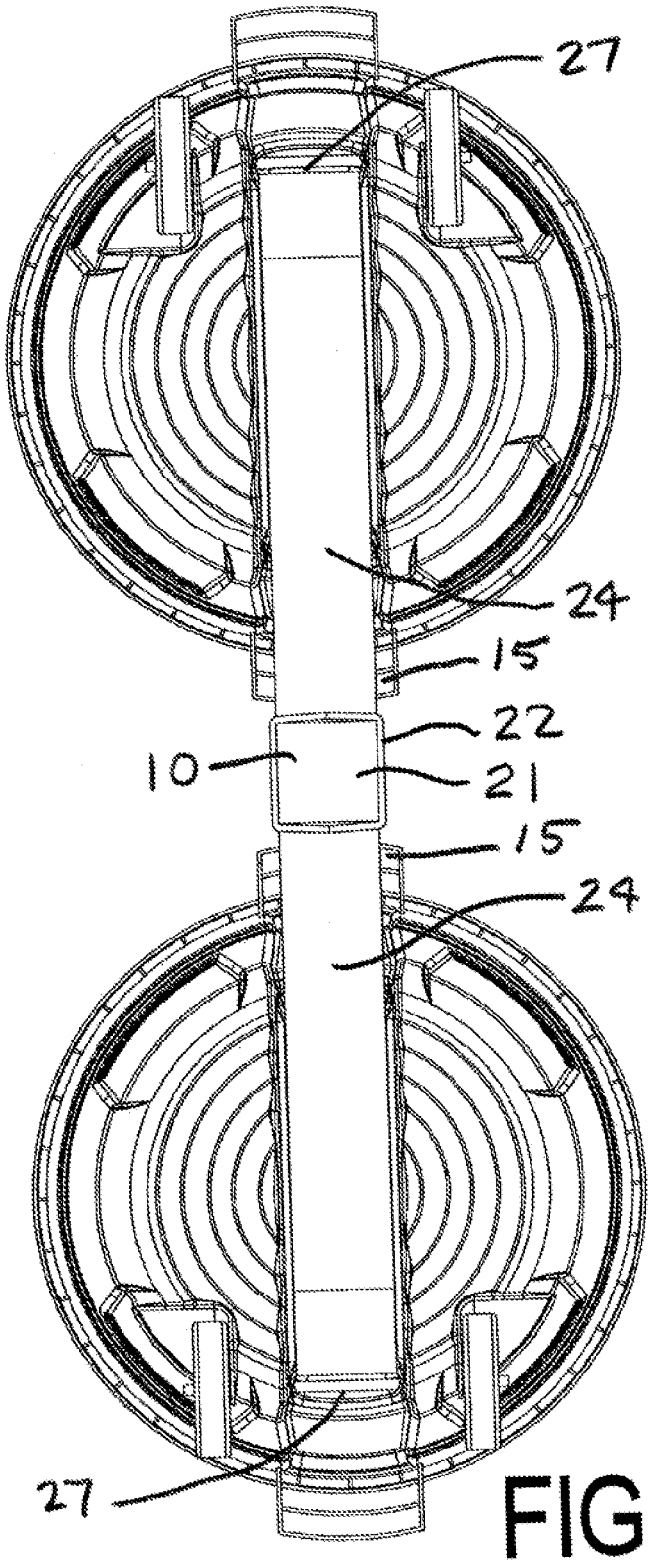
FIG. 5 is a bottom elevation view of the first embodiment shown in FIG. 1.

FIG. 5 is a bottom elevation view of the first embodiment shown in FIG. 1.

Second Embodiment

FIGS. 6 through 10 show a second embodiment of this invention. The horizontal element 16*a* includes a vertical central tunnel 25 and the horizontal element 16*a* is connected to the vertical element 12*a* by sliding the vertical element 12*a* through the vertical central tunnel 25 of the horizontal element 16*a*. This construction allows the base element 21*a* to extend the entire length of the vertical element casing 22*a*, thereby providing a stronger more rigid structure.

Figure 6:
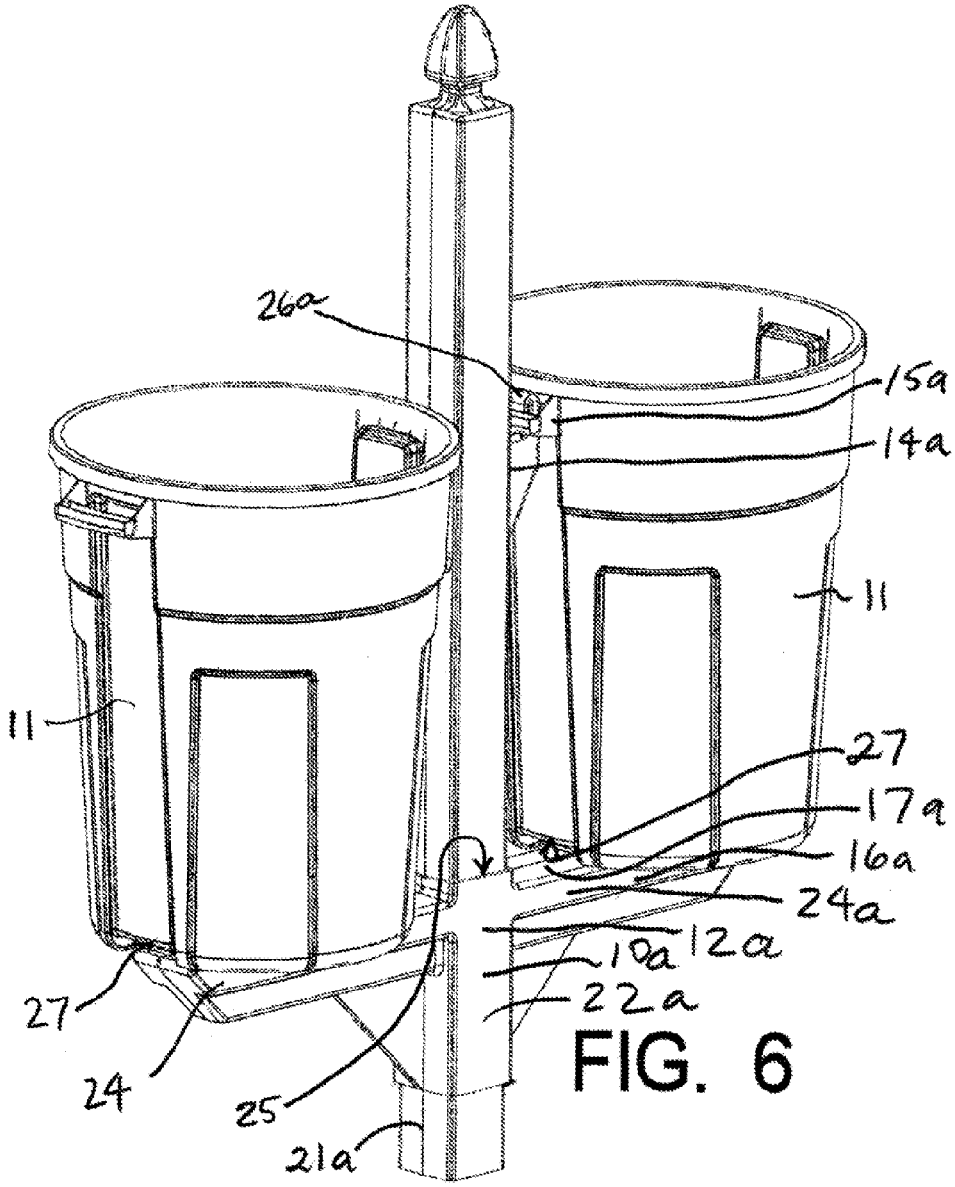
FIG. 6 is a perspective view of a second embodiment of a refuse container holder for holding two refuse containers, the lower portion of the holder being adapted to be buried in the ground, and the holder including a vertical element, two hook elements, and a horizontal element, and embodying the principles of the present invention.

Referring to FIG. 6, in which are shown the general features of the second embodiment of the present invention, this embodiment is shown as a holding device 10*a* for holding and physically stabilizing refuse containers 11, especially when those refuse containers 11 are positioned at the curbside in front of the residence. The device 10*a* includes a vertical element 12*a*, and especially a vertical element 12*a* rendered stationary by being buried in the ground 13. It could also be stabilized by being mounted on a stable base that could be movable with effort but not by the normal wind. The vertical element 12*a* includes one or more upwardly directed hooks 14*a* that include upwardly directed pins 26*a* that are capable of engaging a handle 15 on a refuse container 11 so that the refuse container 11 cannot be overturned or moved by the wind, but can easily be lifted off the hook 14*a* by a refuse collector. Each hook 14*a* is capable of engaging a separate refuse container 11 or several hooks 14*a* could be arranged in a linear manner to more stably engage an elongated handle 15 on the refuse container 11. The holding device 10*a* might also include a horizontal element 16*a*, parallel to and adjacent the ground 13. The horizontal element 16*a* is provided with one or more upper edges 17*a* upon which the refuse containers 11 can sit.

In this embodiment of this invention, the vertical element 12*a* would consist of a base element 21*a* and a vertical element casing 22*a*. The base element 21*a* would typically be formed of a four inch by four inch piece (nominal) of pressure treated lumber and a portion of the base element 21*a* would be permanently buried in the ground 13. The vertical element casing 22*a* would be typically formed of a plastic and would be designed to slide over and completely encase the free end and all exposed surfaces of the base element 21*a* when the bottom of the base element is buried in the ground. This vertical element casing 22*a* would provide a durable protective and decorative surface over the base element 21*a*. Typically, the vertical element casing 22*a* would be sold as a very light and easy-to-ship element of a product kit and would allow a highly stylized attractive product to be produced. On the other hand, the base element 21*a*, which would be heavy, and difficult and expensive to ship, would typically be generic and could be purchased from a local lumber store.

In this embodiment of this invention, each of the containers 11 used with this system would be provided with a groove 27 in the bottom of the container 11, passing entirely from one side of the container to the other. The groove 27 would typically be of rectangular cross-section. As discussed above, the horizontal element 16*a* would be provided with one or more upper edges 17*a* upon which the refuse containers 11 could sit. The groove in the bottom of the container 11 conforms in shape to the upper edges 17*a* of the horizontal elements 16*a*, so that the groove 27 in the bottom of the container 11 encircles and physically engages the upper edge 17*a*. This provides a very stable connection, when combined with the engagement of the upwardly directed hooks 14*a* and the handles 15 of the container, with the holder 10, against unintentional removal of the container from the holder 10*a*.

In this second embodiment of this invention, the horizontal element 16*a* includes a vertical central tunnel 25 and the horizontal element 16*a* is connected to the vertical element 12*a* by sliding the vertical element 12*a* through the vertical central tunnel 25 of the horizontal element 16*a*. This construction allows the base element 21*a* to extend the entire length of the vertical element casing 22*a*, thereby providing a stronger more rigid structure.

FIG. 6 is a perspective view of a second embodiment of a refuse container holder for holding two refuse containers, the lower portion of the holder being adapted to be buried in the ground, and the holder including a vertical element, two hook elements, and a horizontal element, and embodying the principles of the present invention.

Figure 7:
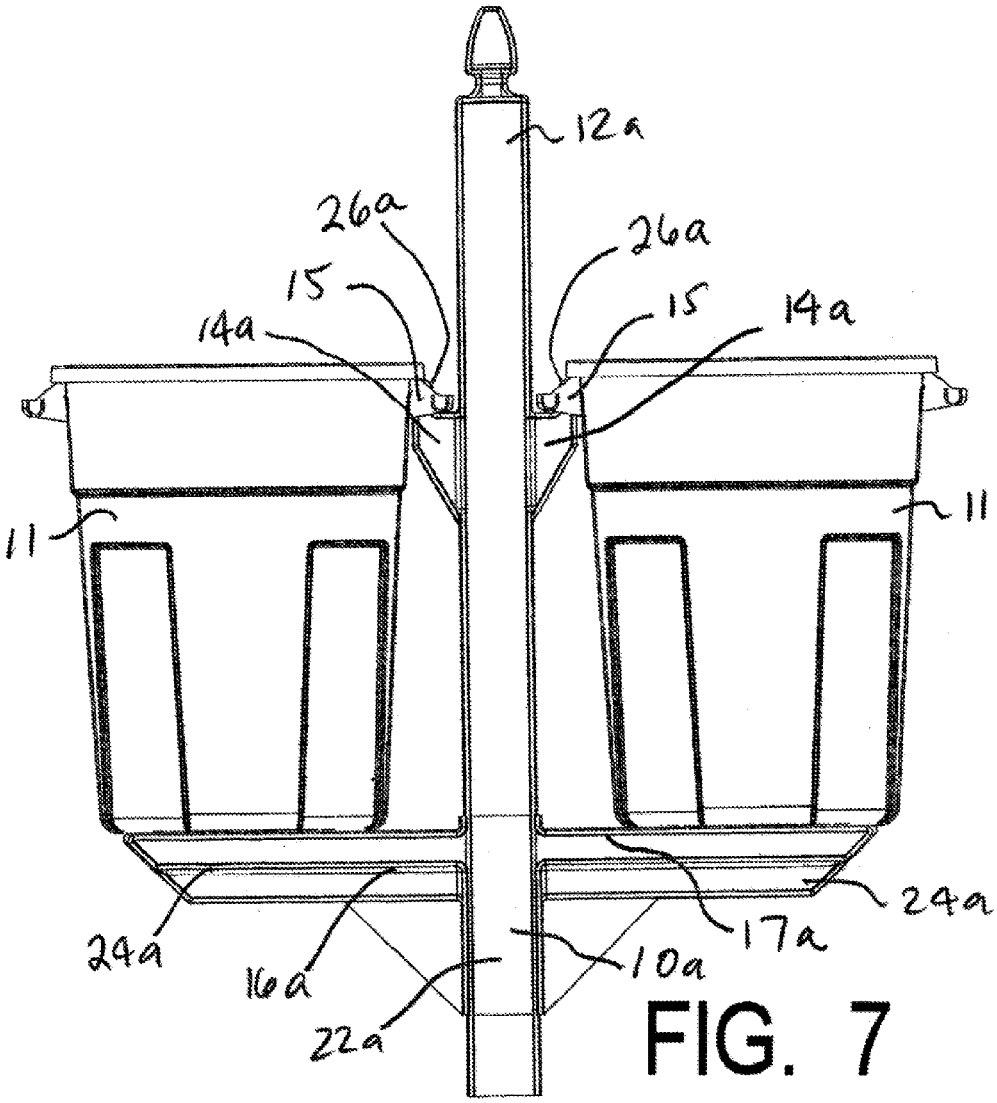
FIG. 7 is a front elevation view of the second embodiment shown in FIG. 6. It is the same as the rear elevation view.

FIG. 7 is a front elevation view of the second embodiment shown in FIG. 6. It is the same as the rear elevation view.

Figure 8:
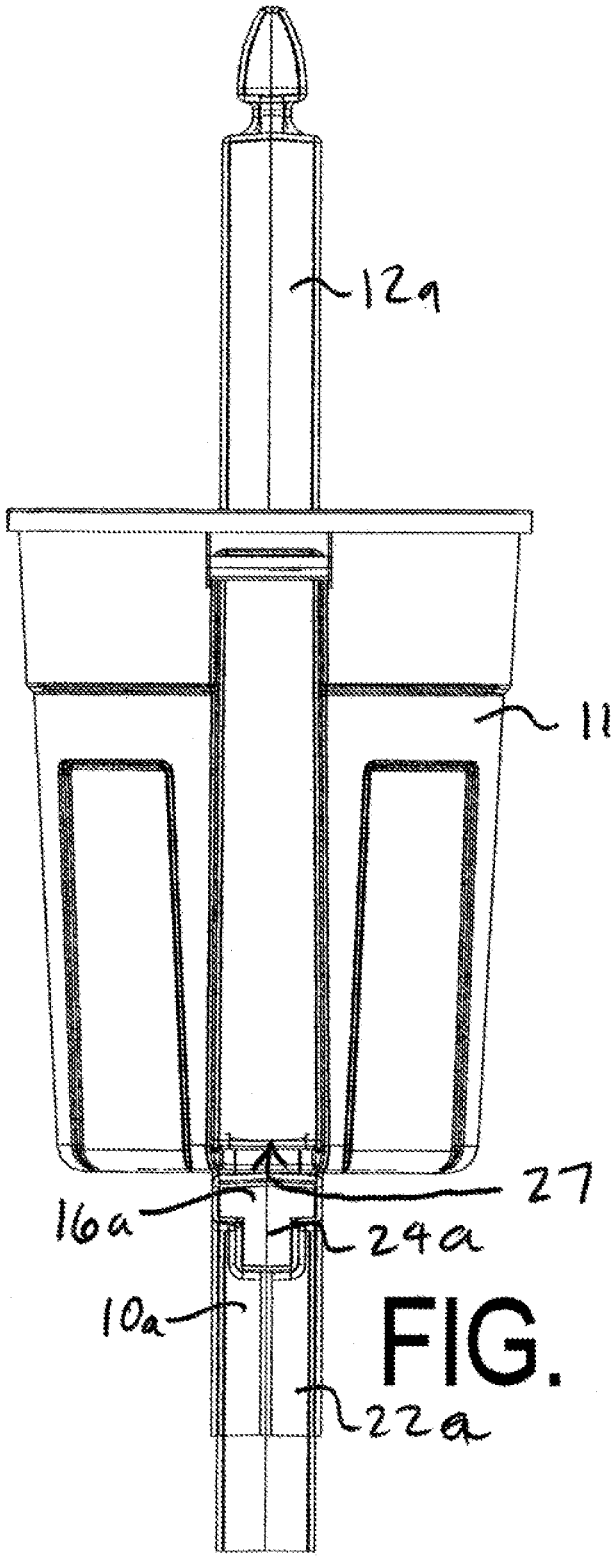
FIG. 8 is a left side elevation view of the second embodiment shown in FIG. 6. It is the same as the right side elevation view.

FIG. 8 is a left side elevation view of the second embodiment shown in FIG. 6. It is the same as the right side elevation view.

Figure 9:
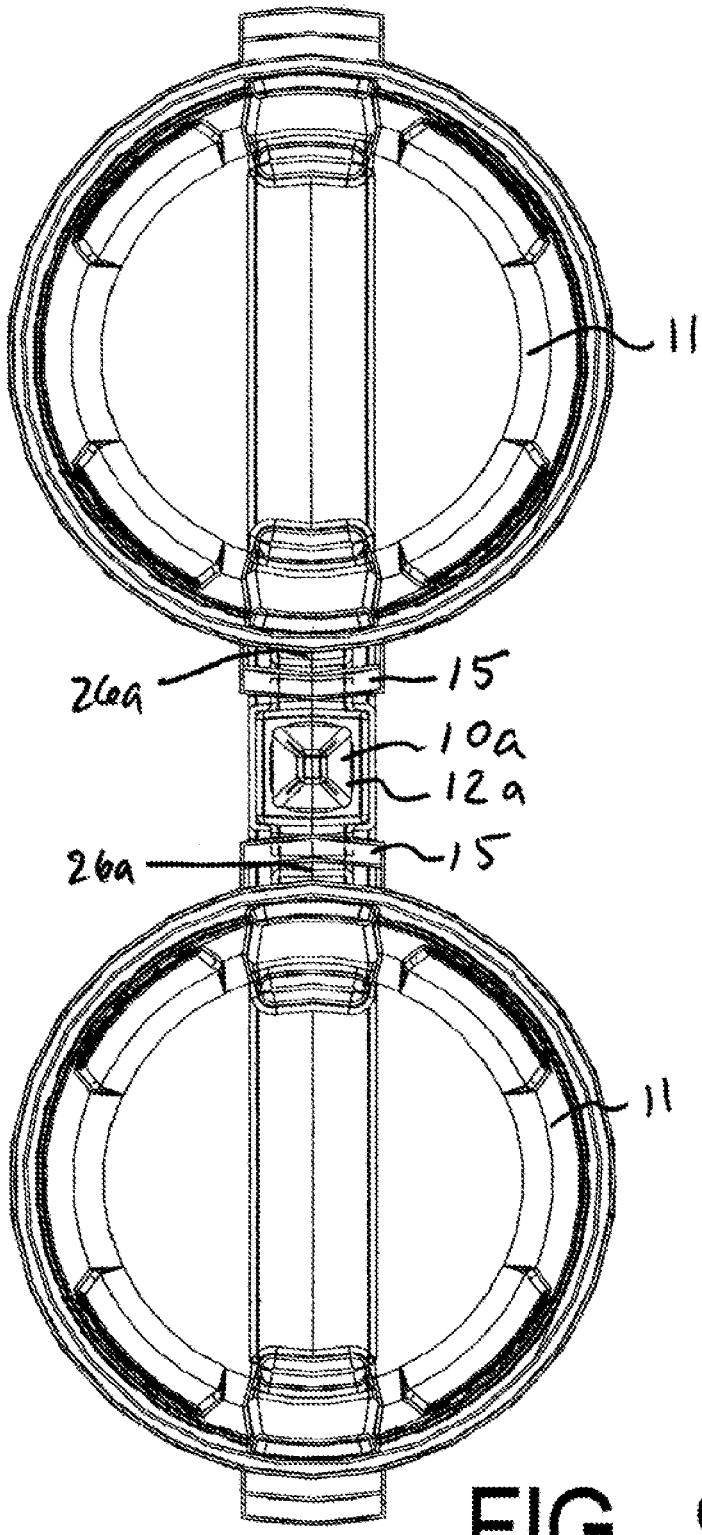
FIG. 9 is a top view of the second embodiment shown in FIG. 6.

FIG. 9 is a top view of the second embodiment shown in FIG. 6.

Figure 10:
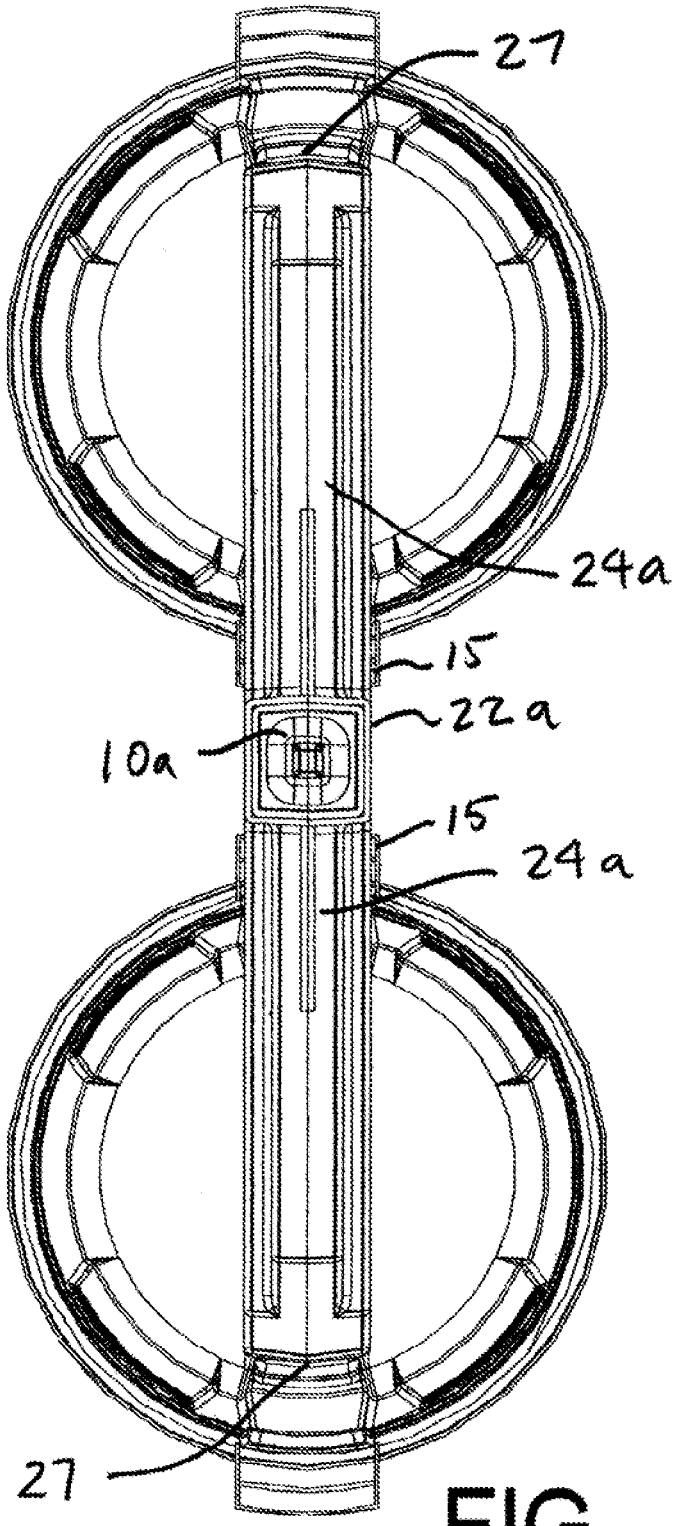
FIG. 10 is a bottom elevation view of the second embodiment shown in FIG. 6.

FIG. 10 is a bottom elevation view of the second embodiment shown in FIG. 6.

Installation

First Embodiment

Figure 11:
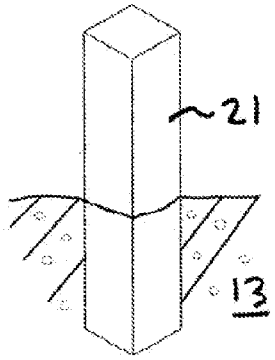
FIG. 11 is a perspective view of the first step in the installation of the first embodiment of the refuse container holder.

The installation of the first embodiment of the invention, as shown in FIG. 11, begins by installing a base element 21 into the ground 13, with an exposed end extending 8 to 12 inches above the ground surface. The base element would typically be 4 in. by 4 in. pressure treated wood.

Figure 12:
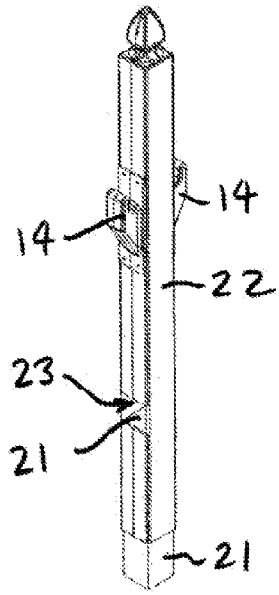
FIG. 12 is a perspective view of the second step in the installation of the first embodiment of the refuse container holder.

As shown in FIG. 12, the vertical element casing 22, typically a hollow piece of plastic, would then be slipped over the exposed end of the base element 21. The vertical element casing is provided with diametrically opposed openings 23. The vertical element casing 22 and base element 21 would be positioned so that the lower edges of the openings 23 aligned with the upper surface of the base element 21. Then, the vertical element casing 22 would be fastened to the base element 21 with nails or screws to form the vertical element 12. The vertical element casing 22 would carry the upwardly facing hooks 14.

Figure 13:
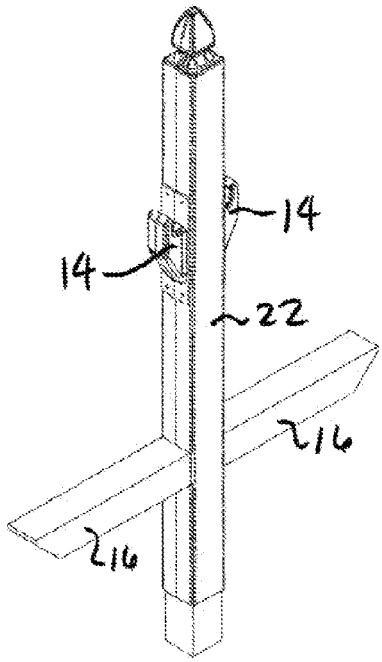
FIG. 13 is a perspective view of the third step in the installation of the first embodiment of the refuse container holder.

As shown in FIG. 13, the horizontal element 16 is slid through the openings 23 in the vertical element casing 22 with the central portion of the horizontal element resting on the top surface of the base element 21.

Figure 14:
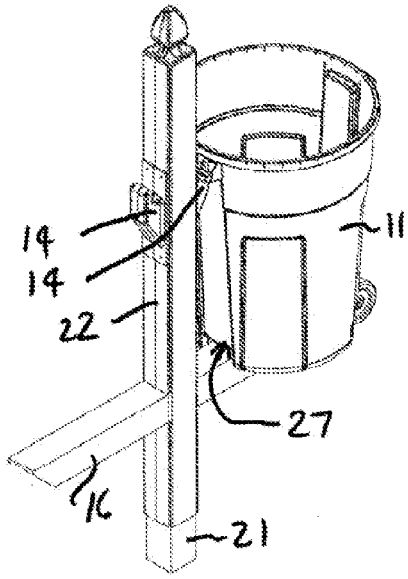
FIG. 14 is a perspective view of the fourth step in the installation of the first embodiment of the refuse container holder.

As shown in FIG. 14, a container 11 is placed on the horizontal element 16 with a handle 15 on the container 11 encircling the pin 26 of one of the upwardly directed hooks 14 on the horizontal element casing 22. A groove 27 in the bottom of the barrel allows the bottom of the barrel to encircle the upper edge 17 of the horizontal element 16 so that the position of the barrel with respect to be vertical and horizontal elements 12*a* and 16*a* is stable against unintentional removal, but can easily be installed and intentionally removed from the structure.

Installation

Second Embodiment

Figure 15:
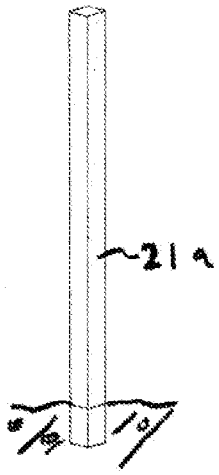
FIG. 15 is a perspective view of the first step in the installation of the second embodiment of the refuse container holder.

The installation of a second embodiment of the invention, as shown in FIG. 15, begins by installing a base element 21*a* into the ground 13, with an exposed end extending 4 to 6 feet above the ground surface. The base element 21*a* would typically be 4 in. by 4 in. pressure treated wood.

Figure 16:
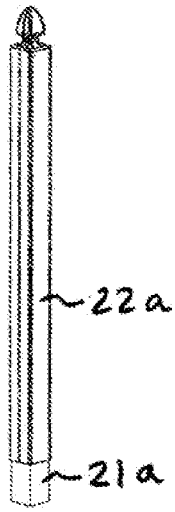
FIG. 16 is a perspective view of the second step in the installation of the second embodiment of the refuse container holder.

As shown in FIG. 16, the vertical element casing 22*a*, typically a hollow piece of plastic, would then be slipped over the exposed end of the base element 21*a*. Then, the vertical element casing 22*a* would be fastened to the base element with nails or screws to form the vertical element 12*a*.

Figure 17:
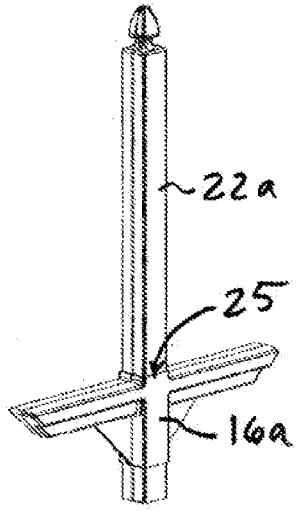
FIG. 17 is a perspective view of the third step in the installation of the second embodiment of the refuse container holder.

As shown in FIG. 17, the central opening 25*a* in the horizontal element 16*a* is slid over the vertical element 12*a* and positioned with the upper surface 17*a* of horizontal arms 24*a* 6 to 12 in above the ground surface. The horizontal element 16*a* is then fastened to the vertical element with nails or screws.

Figure 18:
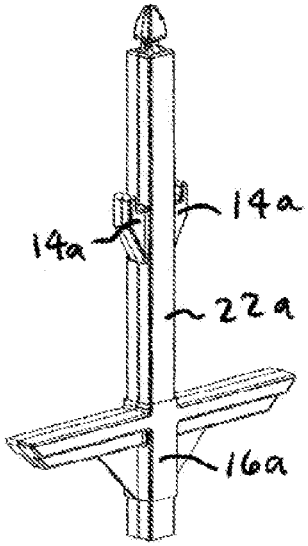
FIG. 18 is a perspective view of the fourth step in the installation of the second embodiment of the refuse container holder.

As shown in FIG. 18, the upwardly directed hooks 14 are positioned appropriately on the vertical element 12*a* and then fastened to the vertical element 12*a* using nails or screws.

Figure 19:
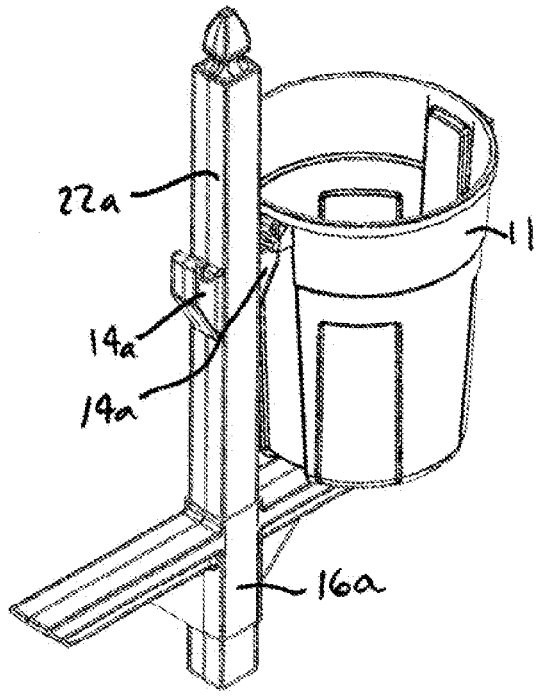
FIG. 19 is a perspective view of the fifth step in the installation of the second embodiment of the refuse container holder.

As shown in FIG. 19, a container 11 is placed on the horizontal element 16*a* with a handle on the barrel encircling the pin 26*a* of one of the upwardly directed hooks 14*a* on the horizontal element casing 22*a*. A groove 27 in the bottom of the container 11 allows the bottom of the container to encircle the upper edge 17*a* of the horizontal element 16*a* so that the position of the container 11 with respect to be vertical and horizontal elements 12*a* and 16*a* is stable against unintentional removal, but can easily be installed and intentionally removed from the structure.

Installation

Alternative Second Embodiment

Figure 20:
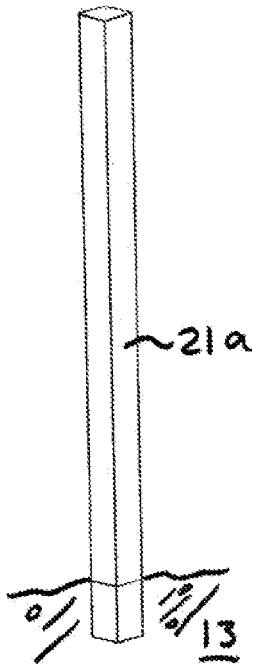
FIG. 20 is a perspective view of the first step in an alternative installation method of the second embodiment of the refuse container holder.

In any variation on the details of the second embodiment and its installation, as shown in FIG. 20, the base element 21*a* is installed just as had been shown in FIG. 15.

Figure 21:
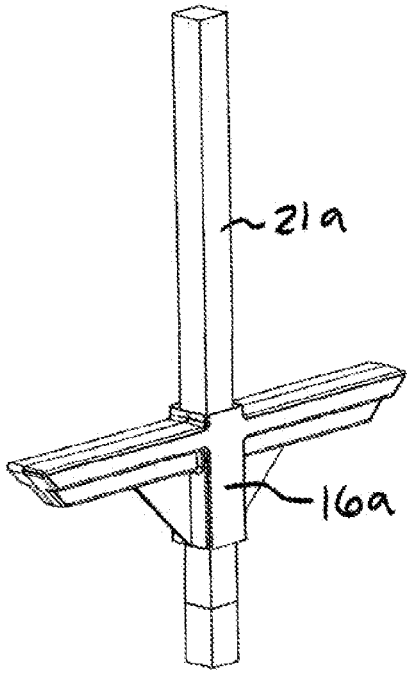
FIG. 21 is a perspective view of the second step in an alternative installation method of the second embodiment of the refuse container holder.

As shown in FIG. 21, the horizontal element 16*a* is then slipped over the base element 21*a*.

Figure 22:
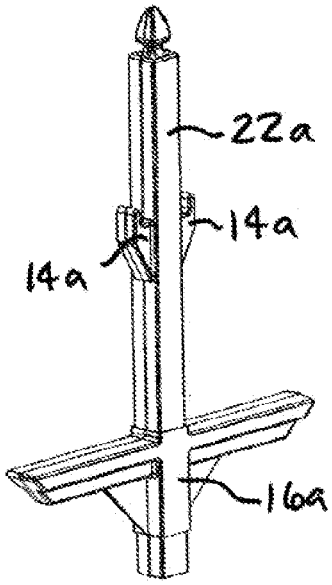
FIG. 22 is a perspective view of the third step in an alternative installation method of the second embodiment of the refuse container holder.

As shown in FIG. 22, the vertical element casing 22*a* including integral or preinstalled upwardly directed hooks 14*a*, is slipped over the base element 21*a*, and slid between the base element 21*a* and the horizontal element 16*a*. Then the vertical element casing 22*a* is fastened to the base element 21*a* using nails or screws. Then, the horizontal element 16*a* is positioned appropriately with respect to the upwardly directed hooks 14.

Figure 23:
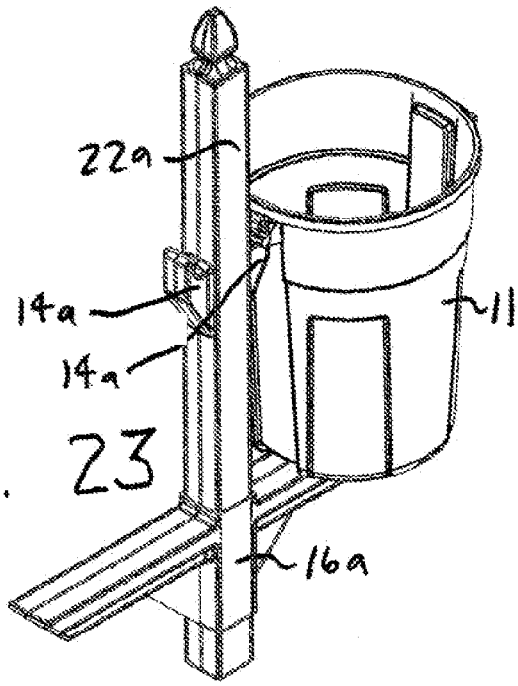
FIG. 23 is a perspective view of the fourth step in an alternative installation method of the second embodiment of the refuse container holder.

As shown in FIG. 23, a container 11 is placed on the horizontal element 16*a* with a handle 15 on the container 11 encircling the pin 26*a* of one of the upwardly directed hooks 14*a* on the horizontal element casing 22*a*. A groove 27 in the bottom of the container 11 allows the bottom of the container 11 to encircle the upper edge 17*a* of the horizontal element 16*a* so that the position of the container 11 with respect to the vertical and horizontal elements 12*a* and 16*a* is stable against unintentional removal, but can easily be installed and intentionally removed from the structure.

While it will be apparent that the illustrated embodiments of the invention herein disclosed are calculated adequately to fulfill the object and advantages primarily stated, it is to be understood that the invention is susceptible to variation, modification, and change within the spirit and scope of the subjoined claims. It is obvious that minor changes may be made in the form and construction of the invention without departing from the material spirit thereof. It is not, however, desired to confine the invention to the exact form herein shown and described, but it is desired to include all such as properly come within the scope claimed.

What is claimed is:

1. A refuse container holder system for holding a container stationary with respect to the ground below the holder, comprising:

a) a container having an open end and a handle adjacent the open end, and also having a bottom separated from the open end, b) a vertical element, adapted to be rendered vertical and stationary with respect to the ground below the holder, and having a hook adapted to selectively engage the handle of the container, and c) a horizontal element attached to the vertical element, parallel to and adjacent the ground below the holder, and having an upper surface and an adjacent upper edge, adapted so that the bottom of the container may sit upon the upper surface, while the hook engages the handle, wherein the vertical element includes a vertical base element adapted to be rendered vertical and stationary with respect to the ground below the holder and having an exposed surface, and a rigid plastic vertical element casing adapted to slide over and cover all exposed surfaces of the vertical base element, said vertical element extending only up to the intersection between the vertical element and the horizontal element, and wherein the vertical element includes two opposed openings that define a channel through the vertical element and through which the horizontal element can slide.

2. A holder system as recited in claim 1, wherein the bottom of the container includes a groove adapted to engage the upper surface and upper edge of horizontal element and thereby restrict the movement of the container with respect to the horizontal element.

3. A holder system as recited in claim 2, wherein the groove conforms complementarily in shape to the upper surface and upper edge of the horizontal element.

4. A holder system as recited in claim 2, wherein the groove has a rectangular cross-sectional shape.

5. A holder system as recited in claim 1, wherein the upper edge of the horizontal element has a rectangular cross-section.

6. A refuse container holder system for holding a container stationary with respect to the ground below the holder, comprising:

a) a container having an open end and a handle adjacent the open end, and also having a bottom separated from the open end, b) a vertical element, adapted to be rendered vertical and stationary with respect to the ground below the holder, and having a hook adapted to selectively engage the handle of the container, and c) a horizontal element attached to the vertical element, parallel to and adjacent the ground below the holder, and having an upper surface and an adjacent upper edge, adapted so that the bottom of the container may sit upon the upper surface, while the hook engages the handle, wherein the bottom of the container includes a groove adapted to engage the upper surface and upper edge of the horizontal element and thereby restrict the movement of the container with respect to the horizontal element, and wherein the vertical element includes two opposed openings that define a channel through the vertical element and through which the horizontal element can slide.

7. A holder system as recited in claim 6, wherein the vertical element includes a vertical base element adapted to be rendered vertical and stationary with respect to the ground below the holder and having an exposed surface, and a rigid plastic vertical element casing adapted to slide over and cover all exposed surfaces of the vertical base element.

8. A holder system as recited in claim 6, wherein the vertical element includes a vertical base element adapted to be rendered vertical and stationary with respect to the ground below the holder and having an exposed surface, and a rigid plastic vertical element casing adapted to slide over and cover all exposed surfaces of the vertical base element, said vertical element extending the entire length of the vertical element casing.

9. A holder system as recited in claim 6, wherein the groove conforms complementarily in shape to the upper surface and upper edge of the horizontal element.

10. A holder system as recited in claim 6, wherein the groove has a rectangular cross-sectional shape.

11. A holder system as recited in claim 6, wherein the upper edge of the horizontal element has a rectangular cross-section.

* * * * *